US007374168B2

(12) United States Patent
Peeters et al.

(10) Patent No.: US 7,374,168 B2
(45) Date of Patent: May 20, 2008

(54) SHEET DEPOSITION SYSTEM HAVING MULTIPLE SUPPORTS DETACHABLY SUSPENDED IN MULTIPLE GUIDE MEMBERS

(75) Inventors: Roger Johannes Maria Peeters, Eindhoven (NL); Nando Leerentveld, Venlo (NL)

(73) Assignee: Oce-Technologies B.V., Venlo (NL)

( * ) Notice: Subject to any disclaimer, the term of this patent is extended or adjusted under 35 U.S.C. 154(b) by 235 days.

(21) Appl. No.: 10/647,384

(22) Filed: Aug. 26, 2003

(65) Prior Publication Data

US 2005/0062224 A1 Mar. 24, 2005

(30) Foreign Application Priority Data

Aug. 26, 2002 (EP) ..... 02078791

(51) Int. Cl.
*B65H 39/10* (2006.01)

(52) U.S. Cl. ..... 271/292; 270/58.14

(58) Field of Classification Search ..... 271/287, 271/288, 292, 294, 298, 300; 414/790.9, 414/791.1; 270/58.14, 58.18, 58.19
See application file for complete search history.

(56) References Cited

U.S. PATENT DOCUMENTS 3,381,830 A * 5/1968 Vasse ..... 414/790.4
3,578,143 A * 5/1971 Woodward ..... 198/794
3,721,435 A * 3/1973 Zanders ..... 271/293
4,332,377 A * 6/1982 DuBois et al. ..... 271/293
5,046,641 A * 9/1991 Gray ..... 221/253
5,531,430 A * 7/1996 Tokunoh ..... 270/58.02
5,626,333 A * 5/1997 Chung et al. ..... 270/58.16
5,772,391 A * 6/1998 Sjogren et al. ..... 414/790.9
5,934,669 A 8/1999 Uchida et al.
6,227,539 B1 5/2001 Ferrara
6,231,045 B1 * 5/2001 Yamada et al. ..... 271/292
6,334,611 B1 * 1/2002 Koo ..... 271/296

FOREIGN PATENT DOCUMENTS

| | | |
|---|---|---|
| DE | 101 56 710 A1 | 6/2002 |
| JP | 3-115058 A | 5/1991 |
| JP | 8-73107 A | 3/1996 |
| JP | 2000-272806 A | 10/2000 |

* cited by examiner

*Primary Examiner*—Patrick Mackey
*Assistant Examiner*—Thomas A. Morrison
(74) *Attorney, Agent, or Firm*—Birch, Stewart, Kolasch & Birch, LLP

(57) ABSTRACT

A sheet deposition system having multiple supports detachably suspended in multiple guide members, wherein a support can be placed in a sheet deposition location or the distance between supports can be altered by driving the guide members. Multiple sheet deposition locations may be provided. The system enables that supports can be easily removed, added or relocated either manually or in an automated manner.

8 Claims, 3 Drawing Sheets

SHEET DEPOSITION SYSTEM HAVING MULTIPLE SUPPORTS DETACHABLY SUSPENDED IN MULTIPLE GUIDE MEMBERS

This non-provisional application claims priority under 35 U.S.C. § 119(a) on Patent Application No. 02078791.7 filed in Europe on Aug. 26, 2002, which is herein incorporated by reference.

BACKGROUND OF THE INVENTION

1. Field of the Invention

The present invention is related to a system for depositing printed sheets on a selected one of multiple supports. The system may be part of an image-forming system such as a printing or copying system.

2. Background of the Invention

In order to reproduce images, it is generally known to feed a medium in sheet or web form through the image forming part of an image reproduction system such as a printing and/or copying system to form images of a marking substance thereon. The printed medium may be subjected to all kind of finishing treatments including but not limited to cutting, punching, inverting, sorting, stapling and folding such as to obtain finished sheets, sets of finished sheets or booklets, hereinafter referred to as sheets. The sheets are forwarded to a sheet deposition location of a sheet deposition system where the sheets are deposited usually on a selected one of multiple trays, hereinafter referred to as supports. The sheet deposition system may be a stand-alone system or may be an integral part of the image reproduction system.

Of particular interest are sheet deposition systems with multiple supports and multiple sheet deposition locations. An example of such a system is a sheet deposition system equipped with two sheet deposition locations, one being a sorting sheet deposition location where sheets are directed to in a sorting mode and the other a non-sorting sheet deposition location where sheets are directed in a non-sorting mode. Typically a single support is available for ejecting sheets thereon in the non-sorting mode when facing the non-sorting sheet deposition location, while an assembly of supports is available which can be moved up and down such that a selected support of the assembly faces the sorting sheet deposition location for ejecting sheets thereon.

In U.S. Pat. No. 5,934,669 a system having a non-sorting exit, a non-sorting bin, a sorting exit and an assembly of sorting bins is disclosed. The assembly of sorting bins can be moved up and down and impart movement to the non-sorting bin. Although the non-sorting bin is movable within a limited range, the flexibility of the system is very limited as the non-sorting bin cannot be used as a sorting bin, or in other words the non-sorting bin cannot be guided such as to face the sorting exit. Moreover, at least a part of the sorting bins cannot be guided such as to face the non-sorting exit. A further disadvantage of the system disclosed in U.S. Pat. No. 5,934,669 is that the spacing between adjacent sorting bins cannot be changed. By consequence, the sheet stacking capacity of the respective bins cannot be adjusted responsive to the size of the job submitted.

In U.S. Pat. No. 6,227,539 a sheet deposition system is disclosed which is provided with a single sheet deposition location and multiple bins. The spacing between selected adjacent bins can be adjusted to control the sheet stacking capacity of a selected bin. The bin capacity adjustment system comprises two pairs of coaxial independently rotatable screw threaded bin movement members, each being provided with a separate drive motor. The bin capacity adjustment solution disclosed in U.S. Pat. No. 6,227,539 is only suitable for a single sheet deposition location and does not enable the user to add or remove bins either manually or in an automated way.

SUMMARY OF THE INVENTION

It is an object of the present invention to provide a flexible sheet deposition system for depositing sheets on a selected one of multiple supports facing a selected one of multiple sheet deposition locations. Particularly, drive means and guide members should be provided such that each support can be moved up and down such as to face each sheet deposition location and such that the distance between adjacent supports can be adjusted.

It is another object of the present invention to provide a flexible sheet deposition system for depositing sheets on a selected one of multiple detachable supports. Particularly, to increase overall flexibility and sheet stacking capacity, guide members should be provided enabling the manual removal, relocation or addition of supports. Preferably, the system should be such as to enable the detachment of supports in an automated way.

It is yet another object of the present invention to provide a flexible sheet deposition system which is equipped with inexpensive means to drive and position the supports.

SUMMARY OF THE INVENTION

In a first aspect of the present invention, a sheet deposition system is disclosed for depositing sheets on at least one of multiple supports comprising:

deposition means for selectively depositing sheets in N sheet deposition locations, N being an integer number $\geqq 1$;

N+1 guide members for guiding the supports, each of said guide members being provided with a plurality of points of suspension for detachably suspending the supports thereon, said guide members being vertically arranged such that each of said sheet deposition locations has an associated lower guide member which is positioned essentially below the sheet deposition location and an associated higher guide member which is positioned essentially above the sheet deposition location;

multiple supports, each of said supports being detachably suspended on one of said plurality of points of suspension of said guide members and arranged one above the other; and drive means for driving said guide members such as to place one of said supports in a sheet deposition location or to alter the distance between supports. The sheet deposition system may be a stand-alone system or may be an integral part of an image reproduction system, such as e.g., a printing or copying system.

Images reproduced by the reproduction system on a printing medium are directed, optionally after buffering and/or storage, to a sheet deposition location of a sheet deposition system. Before arriving at the sheet deposition system, the printed medium may be subjected to all kind of finishing treatments including but not limited to cutting, punching, inverting, sorting, stapling and folding such as to obtain finished sheets, sets of finished sheets or booklets, hereinafter referred to as sheets. The printing medium is typically composed of paper, film, cardboard, label stock, plastic or textile.

In an embodiment of the present invention, the N+1 guide members of the sheet deposition system are endless. Examples of endless guide members are guide members composed of one or more belts or one or more chains, or one or more wires. As the supports are detachably suspended in the guide members in a substantially vertical arrangement, the use of endless guide members enables the deposition of the sheets to the lowest support suspended in the lowest guide member in an automated way on a dolly positioned underneath the lowest support by moving the lowest guide member downwards. This solution is particularly advantageous for removing supports loaded with a large stack of sheets. An advantageous consequence of using supports, which are detachably suspended in the guide members according to the present invention, is that no drive means are attached to the supports themselves, which is beneficial with respect to cost, ease of use and reliability.

In another embodiment of the present invention, the sheet deposition system according to the present invention is provide with multiple sheet deposition locations, or in other words N≧2. In such case, although also applicable when N=1, it may be advantageous to provide at least N+2 supports. The provision of multiple sheet deposition locations enables the direction of sheets to a particular sheet deposition location, dependent on the reproduction mode. For instance, in the case of two sheet deposition locations, sheets produced in a sorting mode are directed to a first sheet deposition location where they are deposited on (a) selected one(s) of multiple supports while sheets produced in a non-sorting mode are directed to the other sheet deposition locations where they are deposited on a bulk support. Alternatively, the respective sheet deposition location may also be selected dependent on format, e.g. A3 vs. A4, or dependent on the finishing steps applied, e.g. single sheets versus booklets.

In another embodiment of the present invention, adjacent guide members of the sheet deposition system are endless and partially overlapping.

In yet another embodiment, each of the N+1 guide members of the sheet deposition system according to the present invention has an associated clutch for transmitting drive thereto. Each of the clutches can be selectively activated, i.e. engaged or disengaged, by control means. To facilitate and ensure synchronisation of the movement of the respective guide members, the clutches are preferably tooth clutches, and more preferably, integer revolution tooth clutches.

In a further aspect of the present invention, a sheet deposition system is disclosed for depositing sheets on at least one of multiple supports comprising:

deposition means for selectively depositing sheets at, at least one sheet deposition location;

a first endless guide member being positioned essentially above the sheet deposition location and a second endless guide member positioned essentially below the sheet deposition location, said first endless guide member and said second endless member partially overlapping each other, the first endless guide member being provided with a first plurality of points of suspension spaced equidistant at a first pitch, P1, for detachably suspending supports thereon, the second endless guide member being provided with a second plurality of points of suspension spaced equidistant at a second pitch, P2, for detachably suspending supports thereon;

at least two supports, each of the supports being detachably suspended on one of the plurality of points of suspension of the endless guide members and arranged one above another; and drive means for driving the endless guide members such that a support suspended on a point of suspension of the first guide member passes to a point of suspension of the second guide member or vice versa. Preferably, the drive means drive the endless guide members such that a support suspended in the first guide member can pass to the second guide member or vice versa without stopping either of the endless guide members.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will now be described in detail with relation to the appended drawings. It will be apparent, however, that a person skilled in the art could contemplate several other equivalent embodiments or other ways of executing the present invention, and thus, the scope of the present invention should only be limited by the terms of the appended claims.

Figure 1:
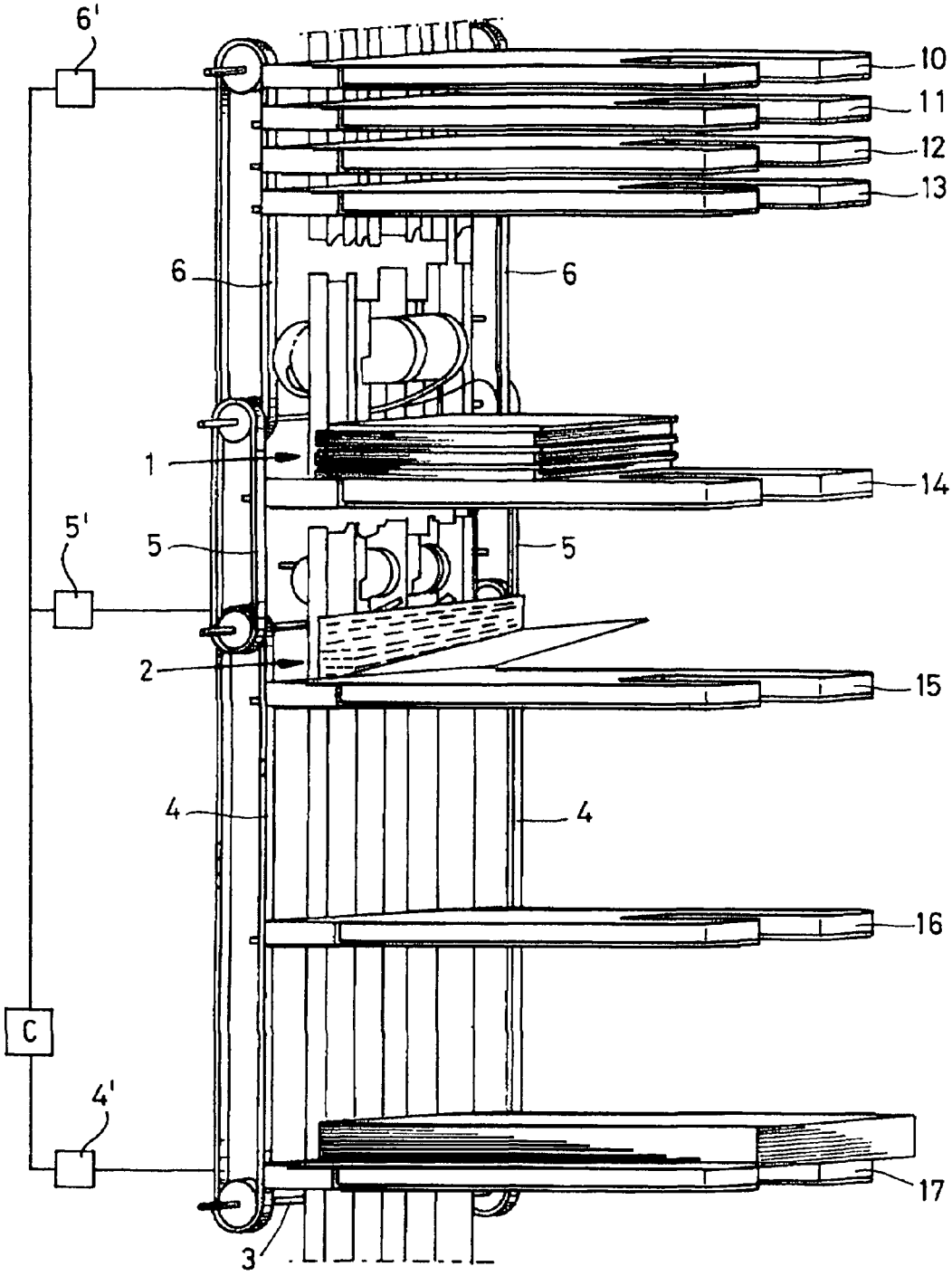
FIG. 1 depicts a schematic representation of a sheet deposition system according to an embodiment of the present invention.

In FIG. 1 a sheet deposition system according to a preferred embodiment of the present invention is depicted. The sheet deposition system comprises two sheet deposition locations, three guide members (4) (5) (6), and eight supports detachably suspended on points of suspension of said guide members. Each of the guide members is composed of a pair of endless chains. The respective chains of each pair are connected via a rod (3) enabling them to move them synchronously. The guide members are vertically arranged one above the other. The first sheet deposition location (1) has an associated lower guide member (5) being positioned essentially below the sheet deposition location and an associated higher guide member (6) positioned essentially above the sheet deposition location. The associated lower guide member (5) and the associated higher guide member (6) partially overlap each other. The second sheet deposition location (2) has an associated lower guide member (4) positioned essentially below the sheet deposition location and an associated higher guide member (5) positioned essentially above the sheet deposition location. The associated lower guide member (4) and the associated higher guide member (5) partially overlap each other. A group of four supports (10) (11) (12) (13) is suspended in the guide member (6) and positioned essentially above the first sheet deposition location. In normal operation, i.e. when sheets are ejected in a selected sheet deposition location on a selected support, only the guide members positioned essentially below the selected sheet deposition location are driven, either actively or by inertia. Because the upper guide member (6) is not moved in normal operation, this guide member can be used for storing spare supports. Spare supports are unloaded supports waiting to be moved into an operative position upon selection. An operative position is a position adjacent a sheet deposition location where sheets can be easily ejected on the selected support. The selected support located in operative position may be unloaded, i.e. empty, or loaded, i.e. already carrying a stack of sheets. In the latter case, sheets are deposited on top of the stack of sheets already present on the support. Spare supports may be manually added on free points of suspension of the upper guide member, even in normal operation. Alternatively, loaded supports may be moved to the upper guide member (6). Doing so increases the overall sheet stacking flexibility and capacity of the sheet deposition system. This overall sheet stacking flexibility and capacity is even further increased by the ability to manually remove or displace loaded supports. The guide member (5) positioned essentially between the two sheet deposition locations carries a single detachable loaded support (14). The lower guide member (4) carries three detachable supports (15) (16) (17). The support (15) is in an operative position with respect to the second sheet deposition location (2).

The spacing between supports suspended in the same pair of chains is fixed and remains constant during movement as long as they are suspended in the same pair of chains. Each support can pass from any guide member wherein it is suspended, to an adjacent guide member. For instance a support suspended in the upper guide member (6) can pass via the middle guide member (5) to the lower guide member (4) and back. This movement is enabled by adequately driving and controlling the respective guide members. In one embodiment of the present invention, each of the guide members and 6 is provided with an associated clutch 4', 5' and 6' which can be selectably engaged or disengaged. Control means C are provided to selectably and independently engage or disengage the clutches. When the clutch is engaged, drive can be submitted to the associated guide member. The configuration may be such that a single drive motor is used to drive the respective guide members. For instance, the drive motor may be positioned such that, when the clutch is engaged, the drive generated by said motor, e.g. a DC motor, is transmitted via one or more gears to one of the chains of the lower guide member (4). As the chains of each pair of chains are interconnected, they always move synchronously. Moreover, when the clutch associated with the middle guide member is also engaged, the drive transmitted to the lower guide member is also transmitted to the middle guide member such that both the middle and lower guide member move in conjunction. Finally, when also the clutch associated with the upper guide member (6) is engaged, all three guide members can be driven in conjunction. Preferably, the clutches used are integer revolution tooth clutches. An integer revolution tooth clutch is a tooth clutch having a revolution distance being an integer multiple of the pitch of the points of suspension of the associated guide member. The use of such clutches enables one to initiate movement of the associated guide member only on discrete positions corresponding to positions of the points of suspension on the guide member to thereby ensure position synchronisation between points of suspension of the respective guide members. This configuration is advantageous with respect to a configuration wherein multiple independently controlled drive motors are provided to drive the respective guide members, not only for reasons of costs, but mainly because of the inherent synchronisation of the movement of the respective guide members. Among others, the synchronised movement of the respective guide members facilitates the transfer of a support from the guide member where the support is suspended to an adjacent guide member.

Figure 2A:
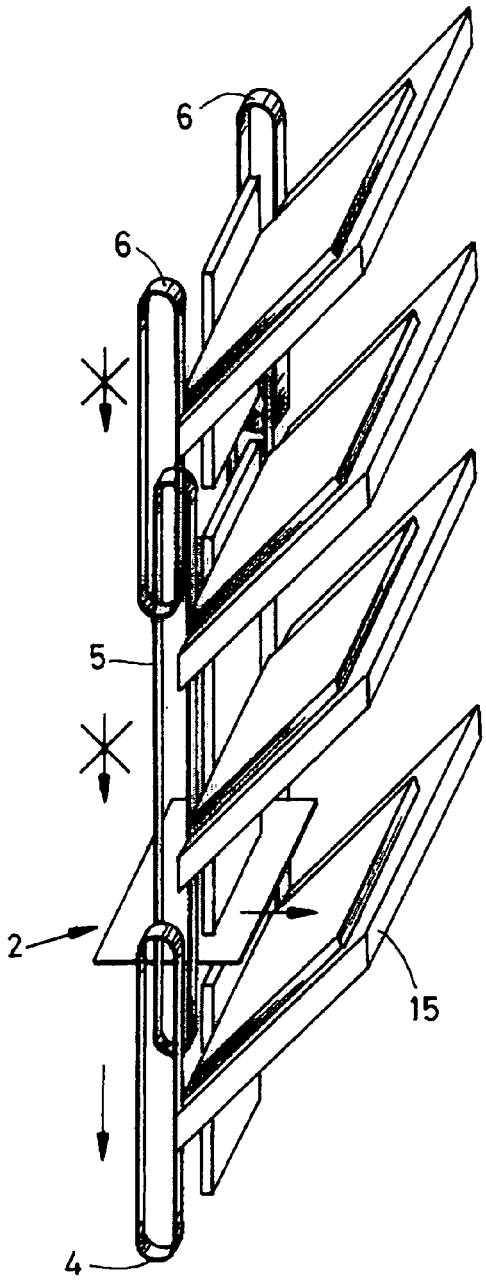
FIG. 2*a* and FIG. 2*b* depict different modes of operation of the sheet deposition system as presented in FIG. 1.

In operation the sheet deposition system is typically used in conjunction with an image reproduction system such as e.g. a printing or copying system. Upon selection of the reproduction mode the image reproduction system directs sheets to the selected output(s). The outputs have to be construed in relation to the sheet deposition locations such that the sheets arriving at an output, at a corresponding sheet deposition location, can easily be deposited by deposition means on a selected support, which is in an operative position with respect to the sheet deposition location. Further referring now to FIG. 1, FIG. 2*a* and FIG. 2*b*, the sheet deposition system depicted has two sheet deposition locations. Therefore multiple reproduction modes are selectable. For instance, in a first reproduction mode, sheets are directed by the image reproduction system (not shown) to a first output (not shown) corresponding to the first sheet deposition location (1). Once arrived at the first deposition location, see FIG. 2*b*, the sheets are deposited by deposition means (not shown) on a selected support (20) in operative position, in this example the support is a loaded support. In a second reproduction mode, sheets are directed by the image reproduction system to a second output corresponding to the second sheet deposition location (2). Once arrived at the second sheet deposition location, see FIG. 1 and FIG. 2*a*, the sheets are deposited by deposition means (not shown) on a selected support (15) in operative position. Particularly, the first reproduction mode may be the sorting mode, while the second reproduction mode is the non-sorting mode. Alternatively, the respective mode may also be selected dependent on format, e.g. A3 vs. A4, or dependent on the finishing steps applied, e.g. single sheets versus booklets. Also a mixed reproduction mode can be applied, wherein the image reproduction system is controlled such that, depending on the control signal sheets, may be directed to the first output corresponding to the first deposition location or to a second output corresponding to the second deposition position. To increase productivity, or in order to deposit sheets at a lower rate than the reproduction rate, a dual reproduction mode may be provided, wherein the image reproduction system directs sheets both to the first output corresponding to the first deposition location and to the second output corresponding to the second deposition position. However, in the latter mode, care should be taken to adequately drive the guide members such that at each sheet deposition location the selected support is maintained in an operative position till the reproduction is finished or till at least one of the supports reaches a capacity limit, e.g. when fully loaded with sheets.

Figure 2B:
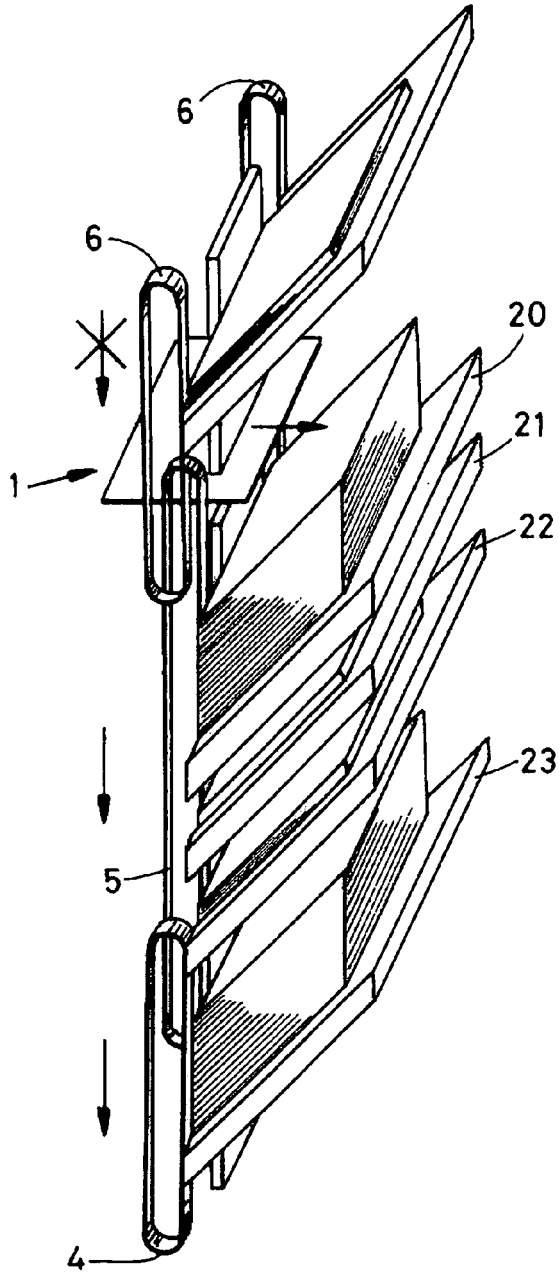

When sheets are deposited at a deposition location on a selected support, the support is progressively lowered as the height of the stack of sheets increases. This may be done actively by adjusting the position of the support responsive to an output signal of a position sensor indicating the vertical position of the support. Alternatively, the lowering of the support may be executed passively, solely by inertia. In any event, not only is the support lowered at the deposition location where the sheets are being deposited, but also all the supports suspended in the same guide member are lowered simultaneously. As indicated in FIG. 2*b,* it may be advantageous not only to move the guide member (5) wherein the support in operative position is suspended, but also to move any other guide member (4) positioned essentially below that guide member (5). Doing so increases flexibility since supports (20) (21) can be lowered without the risk of being blocked by support (22) as this support and support (23) are also lowered. In other words, the spacing between the respective supports, and particularly between supports (21) and (22), is maintained, and the depositing of sheets at the sheet deposition location 2 in FIG. 2*b* may continue till the deposition job is finished or interrupted. Such an interruption may, for instance, be generated because the sheet stacking capacity limit of support (20) is reached or because support (23) is at the end of its range. In the latter case, an end of range sensor may be provided for detecting whether a support reaches a bottom position such that, responsive thereto, the depositing of sheets can be stopped. Alternatively, one could also opt to position a dolly underneath the sheet deposition system at about the bottom position, such that when the support contacts the supporting surface of the dolly, it is detached from the guide member and retained on the dolly. A support, unloaded or loaded, may already be present on the dolly. In the latter case a stack of supports may be formed on the dolly. This solution is made possible because the guide members are endless and the supports are detachably suspended therein, and is particularly advantageous for removing supports loaded with a large stack of sheets. Moreover, overall flexibility and productivity of the sheet deposition system is increased since the depositing of sheets does not need to be interrupted when a support reaches its end of range.

When no sheets are deposited, the respective supports can be repositioned e.g. to maximise the overall sheet stacking capacity, or to bring an unloaded support into an operative position, or to increase the sheet stacking capacity of an individual support by adjusting the spacing between adjacent supports. For instance, the spacing between support (15) and support (16) may be adjusted as described hereinafter. Initially guide member (4) is driven such that the supports suspended therein move upwards, while guide members (5) and (6) stand still. In an embodiment of the present invention, when support (15) approaches the overlapping region between guide member (4) and (5), the upward movement of guide member (5) is initiated such that in said overlapping region support (15) can pass from a point of suspension of guide member (4) to a point of suspension of guide member (5) while both associated guide members (4) (5) move upwards. Alternatively, guide member (4) is moved upwards till the support (15) reaches the overlapping region between guide member (4) and (5). Then the movement of guide member (4) is stopped and the upward movement of guide member (5) is initiated to allow support (15) to pass from guide member (4) to guide member (5). Supports (15) and (16) are now suspended in different guide members. The spacing between these supports (15) (16) can now be adjusted by further moving only guide member (4) upwards to decrease the spacing between the respective supports or downwards to increase the spacing between the respective supports. Once the spacing is adjusted, one may opt to lower support (15) again and let it pass to guide member (4).

Figure 3:
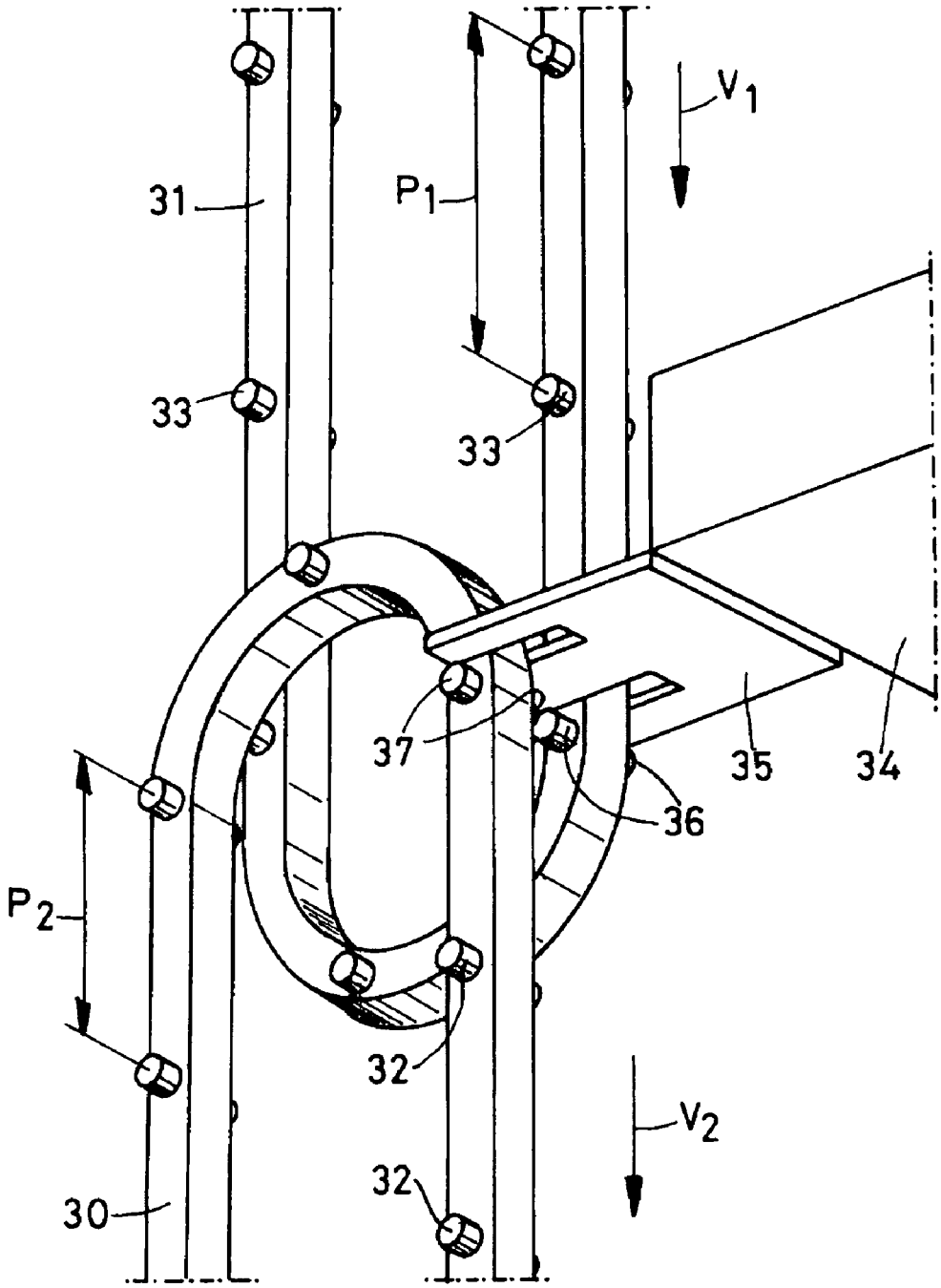
FIG. 3 depicts an enlarged view of the overlapping region between two adjacent guide members of a sheet deposition system according to an embodiment of the present invention.

According to an embodiment of the present invention and referring to FIG. 3, a sheet deposition system is disclosed for depositing sheets on (at least) one of multiple supports. The sheet deposition system comprises deposition means for selectively depositing sheets on at least one sheet deposition location on (a) selected support(s) located in an operative position. The sheet deposition system further comprises a first endless guide member positioned essentially above each sheet deposition location and a second endless guide member positioned essentially below each sheet deposition location, said first endless guide member and said second endless member partially overlapping each other. Each guide member is composed of a pair of chains which are movable in conjunction. Only one chain of said pair of chains is depicted in FIG. 3. Chain (31) is part of the first endless guide member and is provided with a first plurality of points of suspension (33) spaced equidistant at a first pitch, P1, for detachably suspending supports thereon. Chain (30) is part of the second endless guide member and is provided with a second plurality of points of suspension (32) being spaced equidistant at a second pitch, P2, for detachably suspending supports thereon. Each support (34) is suspended in a pair of chains with two forks (35), which rest on the points of suspension of the chains. Each support can pass from a pair of chains wherein it is suspended to any adjacent pair of chains. For instance, support (34) can pass from the upper pair of chains (31) to the lower pair of chains (30). This may be done as described above by lowering the support (34) suspended on points of suspension (36) till the overlapping region between the respective pair of chains (31) (30) is reached, while the lower pair of chains (30) stands still. In the overlapping region, the support (34) passes points of suspension (37) associated with the lower pair of chains, which take over the support (34) such that its forks (35) no longer rest on points of suspension (36) of the upper pair of chains. Then, the movement of the upper pair of chains is stopped. Thereafter, the movement of the lower pair of chains having the support suspended therein is started to thereby complete the pass over. Further according to an embodiment of the present invention, stopping of the chains to establish the pass over of a support can be prevented by providing drive means which are controlled by control means so as to satisfy the following condition:

$$V1 \times P2 = V2 \times P1,$$

wherein V1 is t propagation speed of the upper pair of chains,

V2 is the propagation speed of the lower pair of chains.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet deposition system for selectively depositing sheets in N sheet deposition locations on at least one of a plurality of manually detachable supports, with N being an integer number≧1, which comprises:

N+1 adjacent guide members for guiding the supports, said guide members being vertically arranged such that each of said sheet deposition locations has an associated lower guide member and an associated higher guide member;

a plurality of points of suspension on each of said guide members on which said supports are detachably engaged such that during normal operation each support can be detached from and detachably repositioned to said points of suspension on the guide members regardless of its position on said guide members; and drive means for driving said guide members and enabling the passing of at least one support from one of said guide members to an adjacent one of said guide members.

2. The sheet deposition system as recited in claim 1, wherein the guide members are endless.

3. The sheet deposition system as recited in claim 1, wherein the number of supports is at least N+2.

4. The sheet deposition system as recited in claim 1, wherein N=2.

5. The sheet deposition system as recited in claim 1, wherein each of said guide members is composed of one or more belts, or one or more chains, or one or more wires.

6. The sheet deposition system as recited in claim 5, wherein, when N is an integer>1, a portion of one of the guide members associated with one of said N sheet deposition locations extends beyond a portion of an adjacent guide member associated with an adjacent sheet deposition location.

7. The sheet deposition system as recited in claim 6, wherein each of said N+1 guide members has an associated clutch for transmitting drive thereto, said system further comprising control means for selectively activating at least one of said clutches.

8. The sheet deposition system as recited in claim 7, wherein said clutches are tooth clutches.

* * * * *